United States Patent [19]

Warrick

[11] 3,998,572

[45] Dec. 21, 1976

[54] SPACER-SPRING FOR ROTARY PISTON ENGINES

[75] Inventor: Frank G. Warrick, Muskegon, Mich.

[73] Assignee: Sealed Power Corporation, Muskegon, Mich.

[22] Filed: Nov. 29, 1974

[21] Appl. No.: 528,229

[52] U.S. Cl. ..... 418/142; 277/141

[51] Int. Cl.[2] ..... F01C 19/08

[58] Field of Search ..... 418/142; 167/1.5; 277/141

[56] References Cited

UNITED STATES PATENTS

| | | | |
|---|---|---|---|
| 3,185,386 | 5/1965 | Peras | 418/142 |
| 3,314,682 | 4/1967 | Peras | 418/142 |
| 3,477,732 | 11/1969 | Warrick | 277/141 |
| 3,718,412 | 2/1973 | McCormick | 418/142 |
| 3,762,728 | 10/1973 | Prasse | 277/141 |
| 3,768,936 | 10/1973 | McCormick | 418/142 |
| 3,836,296 | 9/1974 | Sakamaki | 418/142 |
| 3,869,229 | 3/1975 | Kurio | 418/142 |

*Primary Examiner*—William L. Freeh
*Attorney, Agent, or Firm*—Barnes, Kisselle, Raisch & Choate

[57] ABSTRACT

An oil seal for rotary piston internal combustion engines, and method of making the same, comprising a spacer-spring disposed in a circular groove in the rotary piston end face, and a pair of annular oil scraping rails radially spaced from each other within the groove and urged into sealing engagement with the rotor housing end wall by the spacer-spring. The spring includes a pair of circular concentric bands which rest upon the groove root, and a plurality of circumferentially spaced struts connecting the bands and acting to space the rails from each other against respective groove side walls. A plurality of circumferentially spaced spring legs extend from each of the circular bands generally radially across the groove to engage the radially opposite oil scraping rail and urge the rail against the housing end wall.

10 Claims, 9 Drawing Figures

SPACER-SPRING FOR ROTARY PISTON ENGINES

This invention relates to oil seals and, more particularly, to an improved spacer-spring adapted to be used with at least one thin metallic oil scraping rail to form an oil seal in a rotary piston internal combustion engine.

It is an object of the present invention to provide an oil seal for rotary piston engines which will yield reliable sealing over an extended operating period, and which may be easily and economically manufactured and installed into the piston.

It is another object of the present invention to provide an oil seal for rotary piston engines which has a low mass and does not, therefore, significantly increase the inertia of the rotor during periods of acceleration.

In connection with the object stated immediately above, it is yet another object of the present invention to provide a spacer-spring for a rotary piston oil seal which is highly efficient, and which provides maximum sealing spring force per unit of spring mass.

It is a further object of the present invention to provide a rotary piston oil seal which will follow the contours of the engine housing end wall while remaining in sealing engagement therewith.

Still another object of the present invention is to provide an improved method of making a spacer-spring of the above character in an economical and reliable manner.

The novel features which are considered characteristic of the present invention are set forth in particular in the appended claims. The invention itself, however, together with additional objects, features, and advantages thereof will be best understood from the following description when read in connection with the accompanying drawings in which:

Figure 1:
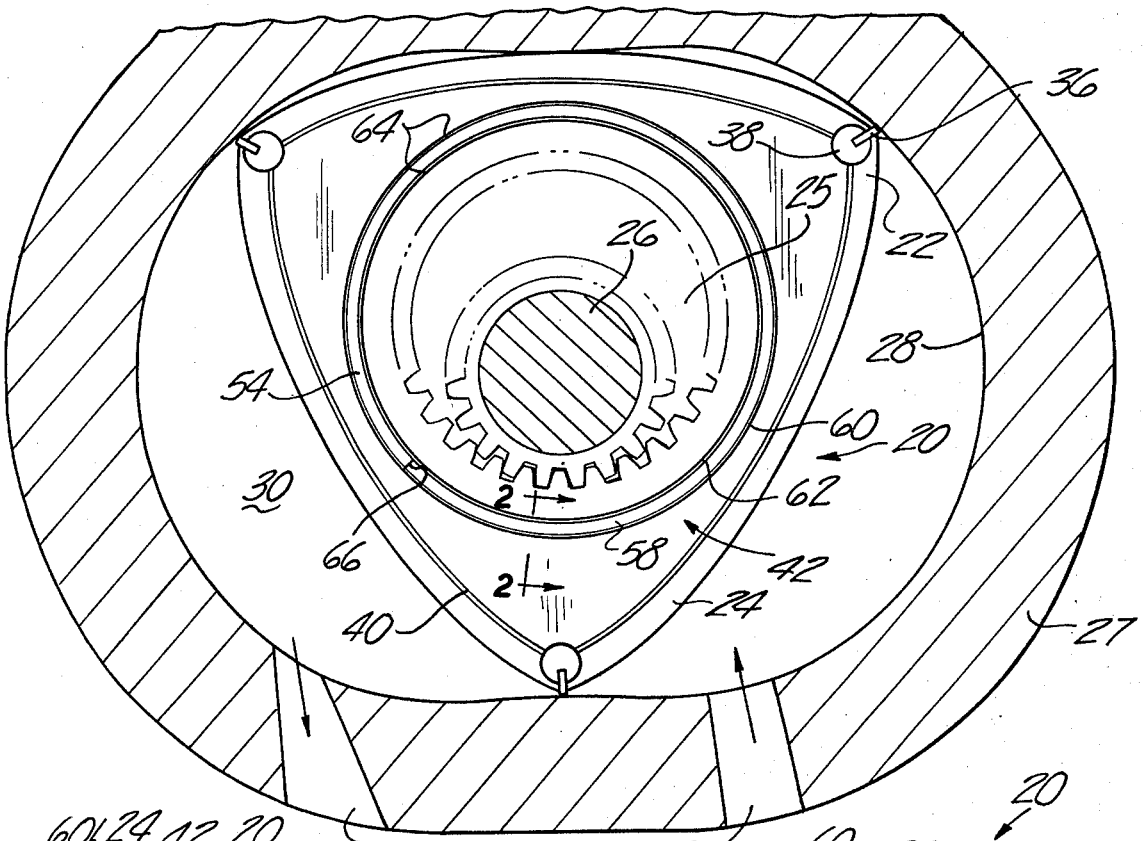
FIG. 1 is an elevated sectional view of a rotary engine piston encased within an engine housing.

Referring to FIG. 1 a rotary internal combustion engine of the type disclosed in the Wankel U.S. Pat. No. 2,988,065 includes a triangular-shaped rotor or piston 20 having three peripheral apexes 22 and a pair of axially outwardly facing substantially flat end faces 24, which piston is mounted to an eccentric shaft 26 for orbital reciprocation within an engine housing 27 having a trochoidally shaped internal peripheral wall 28 and a pair of substantially flat axially inwardly facing end walls 30. The various chambers of the engine are sealed from each other and from the crank case 125 by the apex seals 36 extending from each piston apex 22 to peripheral wall 28, and by the intermediate seals 38 and the compression seals 40 disposed in rotor end face 24 in sealing engagement with housing end wall 30. A fuel intake port 32 and an exhaust port 34 are disposed in peripheral wall 28 to communicate with isolated engine chambers.

Radially intermediate crank case 25 and compression seals 40 is one embodiment of an oil seal 42 of the present invention which is disposed in a circular groove 54 cut into each piston end face 24. Oil seal 42 includes a spacer-spring 58 and a pair of annular oil scraping rails 60,62 radially spaced from each other within groove 54 and urged into sealing engagement with housing end wall 30 by spring 58. Spring 58 is preferably progressively stamped and bent from spring metal stock generally according to the first steps of the method taught in U.S. Pat. No. 3,633,260 of the inventor herein, which patent is incorporated herein by reference. However, in accordance with the present invention the subsequent steps are modified from the method taught in said patent, which modifications are set forth in detail hereinafter.

Figure 5:
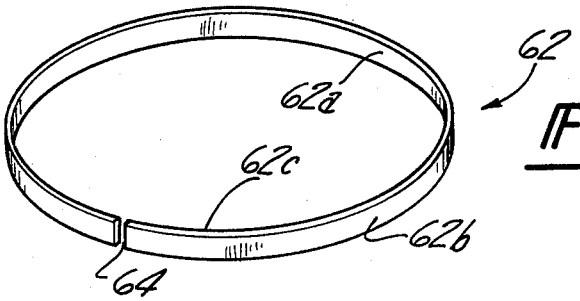
FIG. 5 is a perspective view of one of the oil scraping rails shown in FIGS. 1–4.

Rails 60,62 are formed from ribbon steel coiled edgewise to provide substantially flat radially facing sides **60*a*, 60*b* and 62*a*, 62*b* and relatively narrow axially facing scraping edges 60*c* and 62*c*. FIG. 5 is a perspective view of rail 62, rail 60 having a larger diameter than rail 62 but otherwise being in all respects identical thereto. The small axial dimension of rails 60,62 which is preferably on the order of 0.110 inches as compared to a dimension on the order of 0.024 inches, allows the rails to flex axially and to, thus, better follow contour of end wall 30. Rails 60,62 may be solid but preferably are split or parted as at 64 to further enhance their flexibility. Referring again to FIG. 1, spring 58 is split at 66**.

Figure 2:
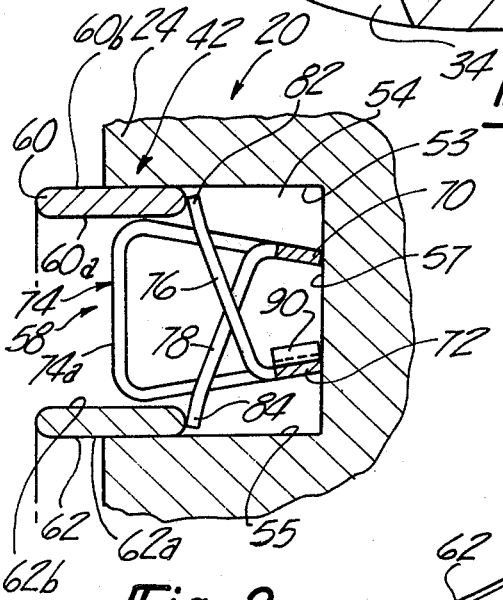
FIG. 2 is a fragmentary sectional view taken along the line 2—2 of FIG. 1 which shows the rotor oil seal as it would appear prior to installation of the rotor body into the engine housing.
Figure 3:
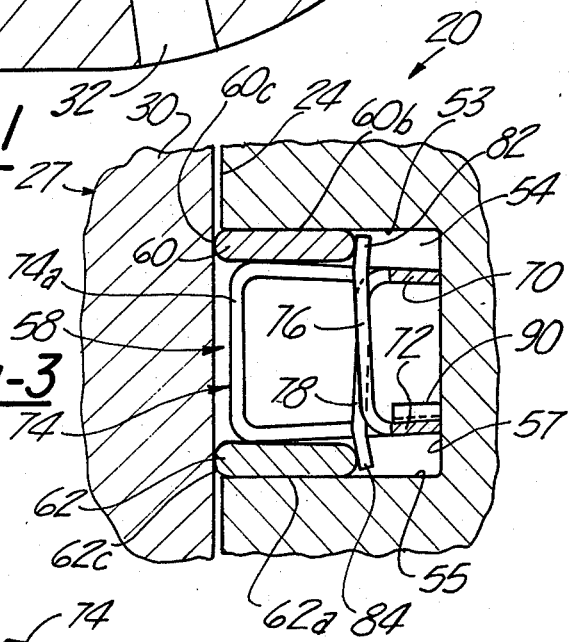
FIG. 3 is a fragmentary sectional view similar to that of FIG. 2 which shows the oil seal in sealing relation with the engine housing end wall.
Figure 4:
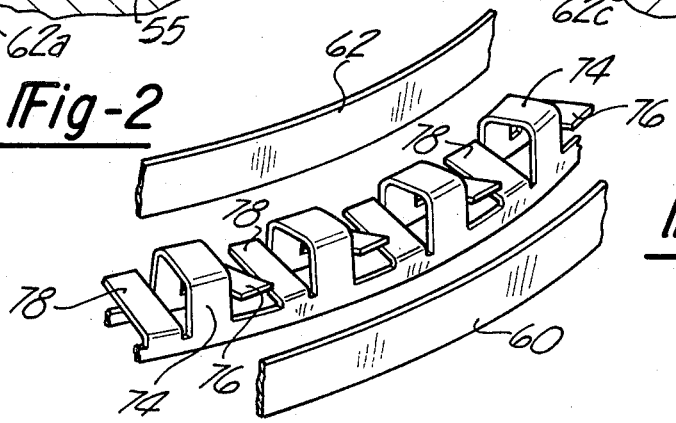
FIG. 4 is a fragmentary, exploded view taken in perspective of the oil seal shown in FIGS. 1–3.

Spacer-spring 58 provided by the present invention is shown in greater detail in FIGS. 2 through 4 and is a modification and adaption of the spacer-expander disclosed in U.S. Pat. No. 3,477,732 of the inventor herein. Referring to FIGS. 2 through 4 herein, circular groove 54 is defined by opposed radially facing concentric side walls 53,55 and an axially facing substantially flat groove root surface 57. It will be noted that axially outward edges **60*c*, 62*c* of rails 60,62 bear against the face of end wall 30 to provide two seals disposed within a single groove 54. Spring 58 includes a pair of concentric generally circular bands 70,72 which rest upon groove root 57 and act as a spring base for the remainder of the spring. A plurality of circumferentially spaced generally C-shaped struts 74 connect bands 70 and 72, the intermediate portion 74*a* of each strut 74 extending axially outwardly between rails 60,62 to space the rails apart from each other such that they are positioned closely adjacent respective groove side walls 53,55. A plurality of circumferentially spaced spring legs 76,78 are connected to bands 72,70 respectively and extend generally radially in opposite array across groove 54 to engage respective radially opposite rails 60,62 and to urge the rails axially outwardly against housing end wall 30** in sealing engagement therewith.

Referring to FIG. 2 it will be noted that, even when spring 58 is in the relaxed condition, spring legs 76,78 engage rails 60,62 axially inwardly of the intermediate portion **74*a* of strut 74 so that the ends of the legs do not protrude axially beyond the strut portions 74*a*, thereby allowing the rails to be readily assembled to spring 58 as they are inserted in groove 54, and to be positioned by the struts adjacent side walls 53,55. It will also be noted with respect to FIGS. 2 and 3 that, when spacer-spring 58 is relaxed as in FIG. 2, strut 74 angulates bands 70,72 axially toward each other. At the same time spring legs 76,78 extend from bands 72,70 at an angle greater than 90°. However, when rotor 20 is inserted into engine housing 27 such that rails 60,62 are in sealing engagement with end wall 30, bands 70,72 are substantially parallel to each other while spring legs 76,78 extend from their respective bands at an angle of approximately 90°. It will thus be appreciated that the force necessary to urge rails 60,62 axially outwardly against end wall 30 is not developed by spring legs 76,78 alone, but is, in fact, developed by the respective spring legs in combination with the spring action of struts 74. Spring 58 thus provides a highly efficient spring force against rails 60,62 per unit mass of spring material used. Furthermore, the springing action of the several struts 74 and the pluralities of spring legs 76,78 are essentially independent of each other so that the struts and legs may flex independently to keep rails 60,62 in sealing contact with end wall 30** in spite of such end wall contour variations as may occur.

Spring legs 76,78 respectively terminate at rails 60,62 in free ends or feet 82 and 84, which free ends are angulated axially inwardly with respect to the major radially extending portion of legs 76,78. When oil seal 42 is in its compressed or operating condition as shown in FIG. 3 so that spring legs 76,78 extend substantially radially, free ends 82,84 are angulated axially slightly inwardly with respect to the radius, thereby exerting a force on rails 60,62 which has both an axial and a radial component. The axial or major force component urges rails 60,62 into sealing engagement with housing end wall 30. The radial force component urges parted rails 60,62 against side walls 53,55 in sealing engagement therewith.

Figure 6A:
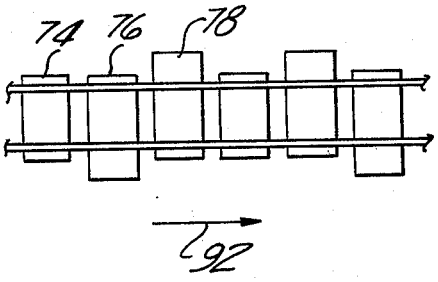
FIG. 6 (A and B) is a fragmentary plan view of the spacer-spring shown in FIGS. 1–4 depicting a method for fabrication thereof.
Figure 6B:
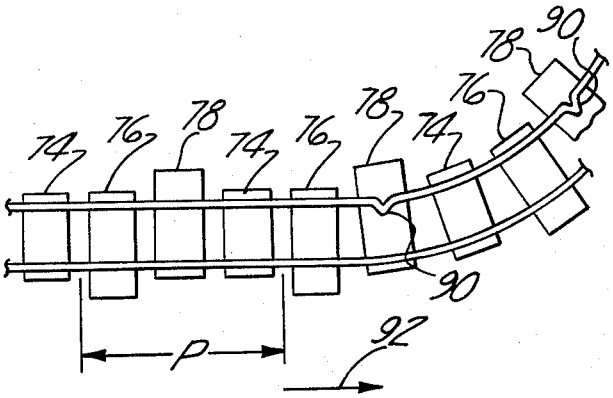
Figure 7:
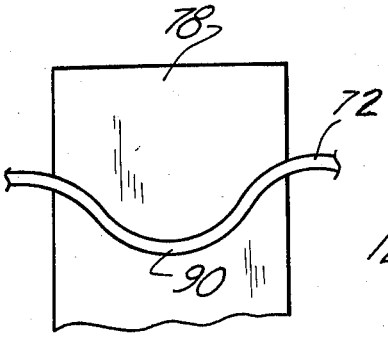
FIG. 7 is an exploded view of one portion of FIG. 6B.

Turning now to FIG. 6, spacer-spring 58 provided by the present invention may be brought to a first stage of fabrication shown in FIG. 6A according to the method of the above-mentioned U.S. Pat. No. 3,633,260, with particular reference to FIGS. 4–23 thereof. Machinery for completing the fabrication stage shown in FIG. 6A is disclosed in the U.S. patents of Roy E. Overway U.S. Pat. Nos. 3,646,797; 3,739,622 and 3,766,765, and also the U.S. patent of Mr. Overway and the inventor herein U.S. Pat. No. 3,701,275. In FIG. 6A struts 74 and spring legs 76,78 are in their final relative geometries and are connected to a pair of parallel linear support bands 70,72. In the subsequent steps of the method of the invention the spacer-spring is coiled in a manner to render it axially compressible. This is accomplished by concurrently coiling both bands 70,72 such that when the coiling operation is completed they describe a pair of concentric but radially spaced circular bands with different diameters. In order to provide a radially inner band 72 having a diameter less than that of outer band 70, the length of band 72 may be effectively reduced and the required coiling operation may be simultaneously performed in accordance with the method of the invention by providing a series of circumferentially spaced semicircular take-up crimps 90 in band 72 shown in FIGS. 6B and 7. Each crimp 90 extends radially outwardly from band 72 in the direction of band 70 so that the crimps will not interfere with side wall 55 when expander 58 is coiled and inserted into groove 54.

Referring specifically to FIG. 6B, partially completed spring 58 leaves the stamping and bending operations discussed in the above-referenced U.S. Pat. No. 3,633,260 patent in the direction 92 and includes a number of segments or pitches P, each pitch P including a single struct 74 and a pair of spring legs 76,78. Spring 58 may be coiled by applying a single take-up crimp 90 in band 72 at each successive pitch P,preferably beneath each successive spring leg 78 as shown. It will be noted that spring leg 78 is not supported by band 72 so that the placement of the crimp in band 72 under leg 78 does not impair the structural connections between band 72 and strut 74 or leg 76.

As disclosed in the referenced U.S. Pat. No. 3,633,260 patent, spacer-spring 58 is preferably fabricated from a continuous length of strip stock, the strip being cut after the coiling operation to produce a number of individual springs. The final spring is thus split or parted as at 66 of FIG. 1 although parting 66 may be omitted and bands 70,72 may be solid or unparted. However, it will be appreciated that, because spring 58 rests upon groove root 57 and because of the above-discussed substantially independent springing action of the struts 74 and the legs 76,78, there is no need for spring 58 to be in abutment at split 66. Indeed, split 66 may comprise a substantial gap so long as the spring action of the spacer-spring immediately adjacent the split maintains rails 60,62 in sealing contact with end wall 30.

Referring again to FIG. 1, the present invention has been described in detail in conjunction with a rotary piston engine having "peripheral porting," i.e., having ports 32,34 located in peripheral wall 28. In this type of rotary engine the pressure within the end face region between compression seals 40 and oil seal 42 averages substantially atmospheric so that oil will not tend to leak through rail splits 64 and past compression seals 40 into the peripheal chambers. It has been found, however, that in "hybrid" or "side ported" engines, i.e., engines having at least the intake port in housing end-wall 30, the vacuum of the intake port causes the pressure in the end face region between seals 40,42 to drop below atmospheric. Under these conditions, rails 60,62 may have a split 64 of the type with an overlap or stepped joint or have sealing means arranged in the gap, such as an elastic sealant adhered to the parted ends of the rail and binding the gap, so that oil does not leak through the splits into the compression chamber, thereby causing smokey exhaust. Alternatively, a modified embodiment of the oil seal provided by the present invention, such as that shown at 100 in FIG. 8, may be used in such hybrid or side-ported engine applications.

Figure 8:
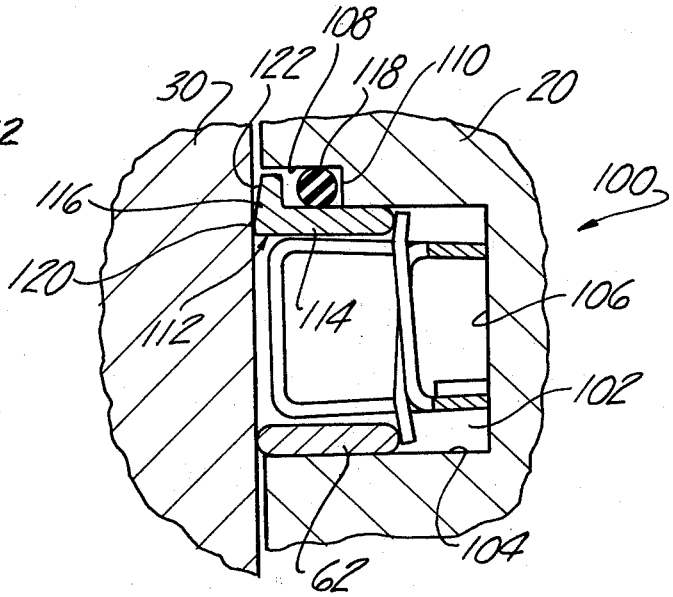
FIG. 8 is a section view similar to that of FIG. 3 showing a modified embodiment of the oil seal provided by the present invention.

Referring to FIG. 8, a groove 102 in the end face of rotor 20 is defined by a radially outwardly facing groove wall 104, an axially facing groove root surface 106 and a radially inwardly facing groove wall 108 which is provided with an axially facing groove shoulder 110. A spacer-spring 58 rests upon groove root 106 and urges a radially inner oil scraping rail 62 into sealing engagement with end wall 30, spring 58 and rail 62 being identical to those shown in FIGS. 1 through 7. An endless or gapless oil scraping rail 112 is disposed in groove 102 in place of rail 60 of FIGS. 1 through 4, and has an annular body 114 which is urged by spring legs 82 into sealing engagement with end wall 30. The axially outer portion of rail 112 which engages end wall 30 has a radially outwardly extending circular lip 116 which captures an elastomeric O-ring 118 between rail 112 and shoulder 110 of groove wall 108. The axially outer surface of rail 112 has a flat contact edge 120 in sealing engagement with end wall 30 and an edge 122 which extends radially along lip 116 at an angle of preferably 3° with respect to the radius.

The advantages of seal 100 should be evident from the foregoing discussion. Endless rail 112 and O-ring 118 provide improved sealing between crank case 25 and compression seals 40 (FIG. 1) so that little or no oil will leak into the intake port in the above-discussed hybrid or side-ported arrangement. Endless rail 112 and O-ring 118 also prevent oil from leaking into the compression chambers when the engine is at rest. Furthermore, because of the relationship of edges 120 and 122 with end wall 30, it will be recognized by those skilled in the art that seal 100 of FIG. 8 tends to gather the oil clinging to end wall 30 and pump the oil back toward crank case 25.

From the foregoing description it will now be apparent that the oil seal provided in accordance with the present invention fully satisfies the objects, aims and advantages set forth above. While the invention has been described in conjunction with two specific embodiments thereof it will be evident that many alternatives, modifications and variations will suggest themselves to persons skilled in the art in view of the foregoing description. Accordingly, the foregoing description is intended to embrace all such alternatives, modifications and variations as fall within the spirit and broad scope of the appended claims.

The invention claimed is:

1. In a rotary piston internal combustion engine of the type in which a piston having a substantially flat axially outwardly facing end face is mounted for orbital reciprocation with respect to an engine housing having a substantially flat axially inwardly facing end wall, an oil seal comprising a circular groove in an end face of said rotor, said groove having opposed radially facing wall surfaces and an axially outwardly facing groove root surface, a first circular oil scraping rail disposed in said groove in proximity to a first of said wall surfaces, and an annular spacer-spring having a pair of concentric circular bands resting upon said groove root surface, a plurality of circumferentially spaced struts connecting said bands and positioning said first rail in proximity to said first wall surface, and a plurality of circumferentially spaced spring legs connected to a one of said bands radially remote form said first rail, and extending generally across said groove to engage said first rail and to urge said rail into sealing engagement with said housing end wall, said bands being formed of continuous lengths of strip material, one of said continuous lengths including a plurality of circumferentially spaced take-up crimps which reduce the effective circumferential length of said continuous length of strip material.

2. The combination set forth in claim 1 wherein each crimp of said plurality of crimps is located in said one of said lengths axially inwardly of the free end of each of said plurality of spring legs.

3. The combination set forth in claim 1 wherein each crimp of said plurality of crimps is located in said one of said lengths circumferentially between a corresponding pair of said plurality of spring legs.

4. The combination set forth in claim 1 wherein said oil seal further comprises a second oil scraping rail disposed in said groove in proximity to a second of said wall surfaces, said spacer-spring positioning said second rail in proximity to said second wall surface and further comprising a second plurality of circumferentially spaced spring legs connected to a one of said bands radially remote from said second rail and extending generally radially across said groove to engage said second rail and to urge said rail into sealing engagement with said housng end wall, said one of said bands being the radially inner of said bands, each of said plurality of crimps being formed in said one of said bands axially inwardly of the free end of each of said second plurality of spring legs respectively.

5. In an oil seal for use in an oil ring groove in the side wall of a rotary piston of an internal combustion rotary engine, said oil ring groove having a bottom surface facing axially outwardly from said piston, annular oil ring sealing means disposed in said groove, and a spring disposed in said groove between said sealing means and said groove bottom surface to bias said sealing means in a direction axially of said piston into sealing engagement with an opposing surface of the housing end wall enclosing the piston chamber of said engine, said spring including radially inner and outer concentric circular bands extending circumferentially of said spring and resting on said groove bottom surface, said spring also including spring legs extending from at least one of said bands adapted to engage said sealing means to impart said sealing bias thereto, the improvement wherein at least said outer band is formed of a continuous length of strip material into a smooth circular band, said inner band including a plurality of circumferentially spaced take-up means which in the aggregate reduce the effective circumferential length of said inner band relative to said outer band.

6. The improvement set forth in claim 5 wherein said inner band is formed of a continuous length of strip material and said take-up means comprises a series of circumferentially spaced portions of said inner band offset from the remaining portions thereof radially of the axis of said spring.

7. The improvement set forth in claim 6 wherein the developed length of said inner band, including the length of said offset portions of said take-up means, is equal to the developed length of said outer band.

8. The improvement set forth in claim 7 wherein said offset portions of said take-up means comprises a plurality of crimps offset radially outwardly from said remaining portions and wherein the extent to which said effective circumferential length of said inner band is reduced by said plurality of crimps is such that said crimps effectively coil said spring for insertion into said groove.

9. In a rotary piston internal combustion engine of the type in which a piston having a substantially flat axially outwardly facing end face is mounted for orbital reciprocation with respect to an engine housing having a substantially flat axially inwardly facing end wall, an oil seal comprising a circular groove in an end face of said rotor, said groove having opposed radially facing wall surfaces and an axially outwardly facing groove root surface, first and second circular oil scraping rails respectively disposed in said groove in proximity to first and second of said wall surfaces, and a one-piece annular spacer-spring having a pair of concentric circular bands resting upon said groove root surface, a plurality of circumferentially spaced struts connecting said bands and positioning said first and second rails in proximity to said first and second wall surfaces, a first plurality of circumferentially spaced spring legs connected to a one of said bands radially remote from said first rail, and a second plurality of circumferentially spaced spring legs connected to a one of said bands radially remote from said second rail, said first and second pluralities of spring legs extending generally across said groove to respectively engage said first and second rails and to urge said rails into sealing engagement with said housing end wall, said bands being angulated axially toward each other and each leg of said pluralities of spring legs extending from its contiguous band at an angle greater than 90° when said spacer-spring is in a relaxed condition, said first and second bands being substantially parallel to each other and each leg of said pluralities of spring legs extending from its contiguous band at an angle of substantially 90° when said rails are in sealing engagement with said housing end wall.

10. In a rotary piston internal combustion engine of the type in which a piston having a substantially flat axially outwardly facing end face is mounted for orbital reciprocation with respect to an engine housing having a substantially flat axially inwardly facing end wall, an oil seal comprising a circular groove in an end face of said rotor, said groove having opposed radially facing wall surfaces and an axially outwardly facing groove root surface, a first circular oil scraping rail disposed in said groove in proximity to a first of said wall surfaces, and a one-piece annular parted spacer-spring having a pair of concentric circular bands resting upon said groove root surface, a plurality of circumferentially spaced struts connecting said bands and positioning said first rail in proximity to said first wall surface, and a plurality of circumferentially spaced spring legs connected to a one of said bands radially remote from said first rail, and extending generally across said groove to engage said first rail and to urge said rail into sealing engagement with said housing end wall, said spacer-spring having circumferentially spaced parted ends which define a gap therebetween in the assembled operative condition of said spring and said rail in said groove.

* * * * *